US007249610B2

(12) United States Patent
Moses

(10) Patent No.: US 7,249,610 B2
(45) Date of Patent: Jul. 31, 2007

(54) RATIO CONTROLLER WITH DYNAMIC RATIO FORMATION

(75) Inventor: Johann Moses, Schorndorf (DE)

(73) Assignee: Karl Dungs Gmbh & Co. KG, Urbach (DE)

( * ) Notice: Subject to any disclaimer, the term of this patent is extended or adjusted under 35 U.S.C. 154(b) by 291 days.

(21) Appl. No.: 10/928,591

(22) Filed: Aug. 27, 2004

(65) Prior Publication Data

US 2005/0058961 A1 Mar. 17, 2005

(30) Foreign Application Priority Data

Aug. 28, 2003 (DE) ..... 103 40 045

(51) Int. Cl.
*G05D 16/16* (2006.01)
*F23D 14/60* (2006.01)
*F23N 1/02* (2006.01)

(52) U.S. Cl. ..... 137/488; 137/489; 431/18; 431/90

(58) Field of Classification Search ..... 137/488, 137/489, 489.5; 431/12, 18, 89, 90
See application file for complete search history.

(56) References Cited

U.S. PATENT DOCUMENTS 5,413,141 A * 5/1995 Dietiker ..... 137/489
5,435,343 A * 7/1995 Buezis ..... 137/489
5,520,533 A * 5/1996 Vrolijk ..... 431/90
6,283,145 B1 * 9/2001 Fenn ..... 137/489
6,533,574 B1 3/2003 Pechoux
6,749,423 B2 * 6/2004 Fredricks et al. ..... 431/90
6,923,204 B2 * 8/2005 Dalton et al. ..... 137/489

FOREIGN PATENT DOCUMENTS

| | | |
|---|---|---|
| DE | 197 40 666 C | 1/1999 |
| EP | 0 644 377 A1 | 3/1995 |
| GB | 1 507 020 | 4/1978 |

* cited by examiner

*Primary Examiner*—Ramesh Krishnamurthy
(74) *Attorney, Agent, or Firm*—Reed Smith LLP

(57) ABSTRACT

For adjustment of a desired burner gas-air ratio over the broadest possible load range without additional pressure tapping of the burner, combustion chamber, or air lines, a ratio controller is provided that permits adjustment of the gas flow as a function of counterpressure. For adjustment, the ratio controller has at least one position-variable measurement site, or at least two measurement sites, connected directly or indirectly via a pilot valve, to an actuating diaphragm via a valve block or throttle valve block. Depending on whether the control pressure is picked up more from one or more from the other measurement site, the gas flow and therefore the gas-air ratio can be adjusted to be larger or smaller.

32 Claims, 5 Drawing Sheets

RATIO CONTROLLER WITH DYNAMIC RATIO FORMATION

CROSS REFERENCE TO RELATED APPLICATIONS

This application claims priority to German Application No. 103 40 045.1, filed Aug. 28, 2003, all of which are incorporated herein by reference.

TECHNICAL FIELD OF THE INVENTION

The present invention is directed generally to a ratio controller for fuel gas metering in gas burners.

BACKGROUND OF THE INVENTION

The invention concerns a ratio controller, especially for fuel gas metering in gas burners, for example, forced-air burners.

In gas burners, a stipulated gas-air ratio must be set at the burners in order to ensure correct operation. The gas-air ratio must then be set independently of the load state. For burners that are in particular to be operated not only at nominal load, but also at partial load, this requires re-adjustment of the gas feed corresponding to air feed. The aim is to permit this with simple, robust and versatile devices.

In the design of gas heating installations, gas boilers and gas burners, system suppliers generally resort to vendor parts that can be incorporated into the overall system that are as much as possible problem-free. An effort is made, in particular, to assure that the assemblies, for example, appropriate ratio controllers, require no special control signals from other assemblies, in order to set the desired gas-air ratio correctly. Additional pressure taps or pressure lines, for example, from the burner to the ratio controller, represent undesirable limitations from the standpoint of the system supplier.

A ratio controller that regulates the gas feed to a burner is known from DE 197 40 666 C1. A ratio controller, to which a first pressure tap in the gas line and a second pressure tap in the combustion chamber are connected, is used for the desired adjustment of a stipulated gas-air ratio. Both pressure taps are provided with a throttle valve. Gas flows into the combustion chamber via the connection path between the two taps. A control pressure for the ratio controller is tapped between the throttle valve valves.

An additional pressure tap in the combustion chamber is often not present, so that use of this ratio controller is restricted.

Another ratio controller is known from EP 06 44 377 B1, which is formed by a pilot-controlled control valve provided with an actuating diaphragm. A pressure tap in the gas line leading to the burner, as well as two additional pressure taps in the air line leading from a blower to the burner, serve for pilot control. The two pressure taps in the air line record the pressure difference across a throttle valve location.

In this arrangement, an undesired hampering of air flow develops through the throttle valve location behind the forced-air burner. The pressure drop caused by the throttle valve must be overcome by the blower. This should be done in particular with respect to possible adjustments to different burner operating conditions, like loads, etc., as well as with respect to varying gas composition or the like.

With this as the point of departure, the task of the invention was to devise a simple and robust ratio controller without external pressure taps.

SUMMARY OF THE INVENTION

The present invention provides a ratio controller without external pressure taps. The ratio controller according to the invention has a main valve with an actuating diaphragm, in which a pulse channel serves to control the actuating diaphragm. This permits pressure tapping of the outflow chamber of the ratio controller selective or simultaneous of at least two different measurement sites. By choosing the measurement site, the gas pressure occurring at the output of the ratio controller as a function of the gas velocity can be regulated to correspond to a stipulated gas-air ratio. It is also possible to maintain this gas-air ratio over different load conditions from an extremely low load to full load. No external pressure taps are required for this.

Formation of the correct pressure ratio at the gas nozzle is effected as a function of the pressure difference at the air feed (air nozzle). If the air nozzle and gas nozzle, for example, are seated at the blower intake connection, both the air pressure and the gas pressure in front of the gas nozzle diminish uniformly with increasing blower speed and therefore increasing air throughput. Readjustment of the ratio controller is therefore effected by means of the gas pressure in front of the gas nozzle. This occurs pneumatically by means of a special throttle valve arrangement. The pressure controller is set so that it roughly adjusts the static pressure (atmospheric pressure) at the gas nozzle. Opening of the controller then occurs pneumatically from the pressure applied during an air and gas reduction.

The pressure taken off on the outflow side of the valve directly in the outflow chamber, or also at the gas nozzle, and a pressure tapped at another location together form in an adjustable ratio a control pressure to control the pilot valve for the ratio controller. By adjusting the ratio by which the tapped pressures are incorporated into the control pressure, an adjustment of the ratio controller to different types of gas or burner valves or excess-air factors is possible. The output pressure set by the ratio controller can then be made constant over a wide power range. To adjust a ratio controller, the ratio according to which the two pressure taps are used to form a control pressure can be set either by means of a three/two distribution valve, or by throttling only one branch of the branching pulse channel, a fixed or adjustable throttle valve being arranged in the other branch. The adjustment can occur both manually and via a remote-controlled adjustment device, for example, a magnetic valve, a servomotor, or the like. The latter offers the possibility of subordinating gas quantity regulation to a control device. The control device can be connected, for example, to appropriate sensors that record the calorific value of the gas, or the CO content, the $O_2$ content or the $NO_x$ content of the exhaust. Correction of the gas-air ratio can then be effected on the basis of these measured values, in which the correction again applies for a broad power range.

Additional advantages of the invention can be ascertained from the drawings, the description, and/or the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
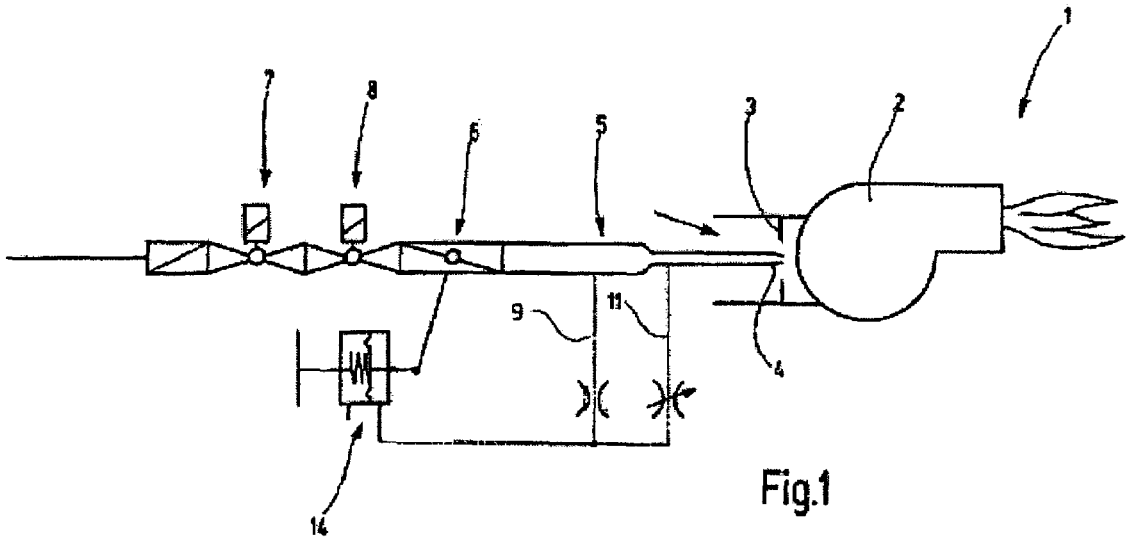
FIG. 1 shows a forced-air burner with ratio controller connected in front, as well as additional gas valves to control operation.
Figure 2:
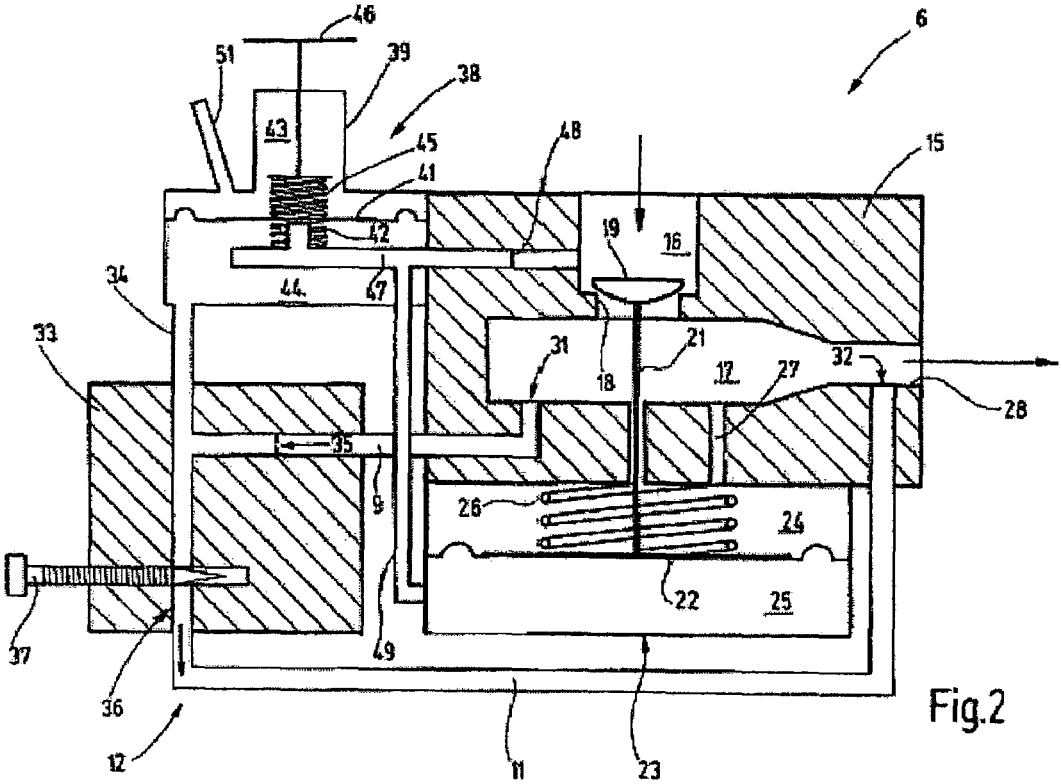
FIG. 2 shows the ratio controller according to FIG. 1 in a schematic cross section.

A forced-air burner 1 with a blower 2 connected upstream is shown in schematic form in FIG. 1, the blower drawing in a gas-air mixture. For this purpose, the blower 2 has an air jet 3 on the input side, in which a gas nozzle 4 is arranged. This is fed from a gas line 5, upstream of which a ratio controller 6 and control valves 7 and 8 are connected. The latter serve to release and block the gas. With control valves 7, 8 open, the ratio controller 6 serves to adjust a stipulated gas-air ratio independently of the supply power of the blower 2, i.e., its speed. The ratio controller 6 performs this merely by tapping its own valve housing or the gas line 5, without measurement or tapping of the amount of air. For this purpose, on the path between the ratio controller 6 and gas nozzle 4 at least two different flow cross sections are formed in the gas line 5 or in the housing of ratio controller 6, from which branches 9, 11 of a pulse line 12 branch off. This serves to control a control drive 14 that regulates the ratio controller 6. FIG. 2 can be referred to for an understanding of the layout and function of the ratio controller 6. The ratio controller 6 shown here has a housing 15, in which a through channel is formed. This includes an inflow chamber 16 and an outflow chamber 17. A valve seat 18 is formed between the two, which is associated with a valve closure element 19. The latter is connected via a valve stem 21 to the diaphragm 22 of an actuating diaphragm 23. The diaphragm 22 separates two working chambers 24, 25 in its housing. A spring 26 tightens the valve closure element 19 via the valve stem 21 against valve seat 18. A connection channel 27 is arranged between the outflow chamber 17 and the working chamber 24, whose underpressure causes opening of the valve closure element 19, thus ensuring pressure equalization between the outflow chamber 17 and the working chamber 24.

In addition, two pressure taps in the form of openings 31, 32 are provided in the outflow chamber 17 or in the gas line 5 connected to its output 28, at which different flow conditions prevail. For this purpose, for example, the outflow chamber 17 is provided in a first region with a relatively large flow cross section and in a second region with a relatively small flow cross section. The measurement sites (openings 31, 32) are arranged in these different regions. Gas flows of different velocity accordingly prevail in front of these openings 31 32, so that different pressures are recorded at the openings 31, 32. Branches 9, 11 extend away from the measurement sites or openings 31, 32, which belong to the pulse line 12. The branches 9, 11, for example, lead to a throttle valve block 33, which combines the two branches 9, 11 and connects them to a pressure measurement line 34, also belonging to the pulse line 12. The throttle valve block 33 combines the two branches 9, 11, for example, as a T- or Y-branch. A fixed throttle valve 35 can be arranged in branch 9. An adjustable throttle valve 36 is preferably arranged in branch 11. This can be formed by a reversing screw 37 that is screwed into the throttle valve block 33 and is sealed to the outside, and whose pointed end opens branch 11 more or less, depending on the adjustment. If necessary, the function can also be reversed, with the throttle valve 35 being adjustable and the throttle valve 36 being fixed. If necessary, both throttle valve valves can be made adjustable.

The pressure measurement line 34 leads to a pilot valve 38. This has a diaphragm 41, accommodated in a housing 39, that is arranged in the immediate vicinity of a gas outlet opening 42. The diaphragm 41 separates housing 39 into an air chamber 43 and a control chamber 44. The control chamber 44 is connected to the pressure measurement line 34. The pressure difference prevailing between the air chamber 43 and the control chamber 44 determines the position of diaphragm 41. This is arranged with reference to the gas outlet opening 42, so that the gas outlet opening 42 is closed when the air pressure predominates, whereas it has the tendency to open when the gas pressure predominates. A spring 45, which can be adjusted by means of an appropriate set screw 46, adjusts the null point of the diaphragm 41, i.e., the pressure ratio at which the diaphragm 41 lies precisely on opening 42. This is a null point adjustment, wherein a change in mixing ratio, dependent on power, can be achieved by changing the spring bias. The lower power range is primarily influenced, however, The gas outlet opening 42 is part of a line 47, with which the gas pressure from the inflow chamber 16 is optionally tapped via a throttle valve 48. A line 49 that leads to the working chamber 25 branches off from line 47.

In the simplest case, the air chamber 43 is connected to the surrounding air. Optionally, however, i.e., if desired, a connection 51 can be provided with which the air chamber 43 can be connected to a pressure measurement site that records the air pressure in front of the mixture formation device. This is particularly expedient if the pressure differs significantly from the ambient air pressure.

In conjunction with the system shown in FIG. 1, the ratio controller 6 described so far operates as follows:

With opening the control valves 7, 8 shown in FIG. 1 an underpressure is produced by the blower 2 at air jet 3. This initially passes through the gas line 6 and is therefore recorded at measurement sites 31, 32. The underpressure reaches the pilot valve 38, in the ratio established by the throttle valve block 33, via the pressure measurement line 34 and therefore also generates a certain underpressure in the control chamber 44. This leads to closure of the gas outlet opening 42, so that the gas pressure applied via line 47 is less reduced and can therefore reach the working chamber 25 via line 49. At the same time, the underpressure penetrating the outflow chamber 17 via the gas line acts on the opposite side of diaphragm 22 via connection channel 27. A pressure difference is therefore produced that moves the diaphragm 22 upward and therefore moves the valve closure element 19 in the opening direction. This process lasts until the prescribed reference pressure at the gas nozzle 4 is reestablished in the outflow chamber 17.

During this process, the gas velocity is taken into account, and all the more so the further the reversing screw 37 is opened. The gas flow produced by a specific underpressure at the gas nozzle can therefore be finely regulated at the reversing screw 37. The gas-air ratio is kept constant over a broad power range of the forced-air burner 1, corresponding to a desired value. If the blower speed and therefore the air supply increase, the counterpressure on gas nozzle 4 drops simultaneously, which results in a correspondingly increased gas flow. The extent to which the gas flow increases with the increasing pressure drop can be set at the reversing screw 37.

Tapping a combustion chamber and other air taps at the blower or burner are not necessary for this purpose.

Figure 3:
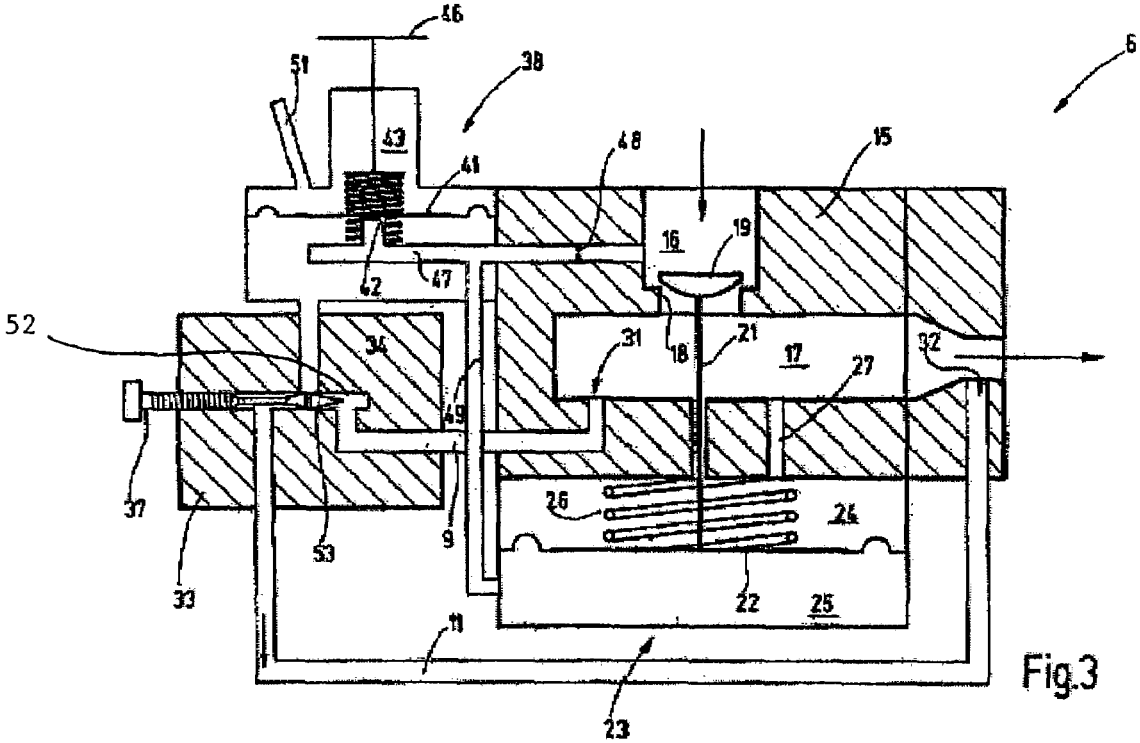
FIG. 3 shows a modified embodiment of a ratio controller in a schematic cross section.

FIG. 3 shows a modified embodiment of the ratio controller 6. If agreement with the described embodiment exists, the same reference numbers refer to the aforementioned description. The difference between a ratio controller 6 according to FIG. 2 and that according to FIG. 3 lies in the throttle valve block 33. This is designed according to FIG. 3 as a three/two distribution valve. The branches 9, 11 discharge in a common channel 52, in which a spindle-like control element 53 is situated. This is connected to the reversing screw 37. The pressure measurement line 34 branches off in the vicinity of the mid-line of the regulation element 53. With the regulation element 53, the ratio of the pressures tapped from the measurement sites 31, 32 can be adjusted, which contributes to formation of a control pressure for pilot valves 38.

Figure 4:
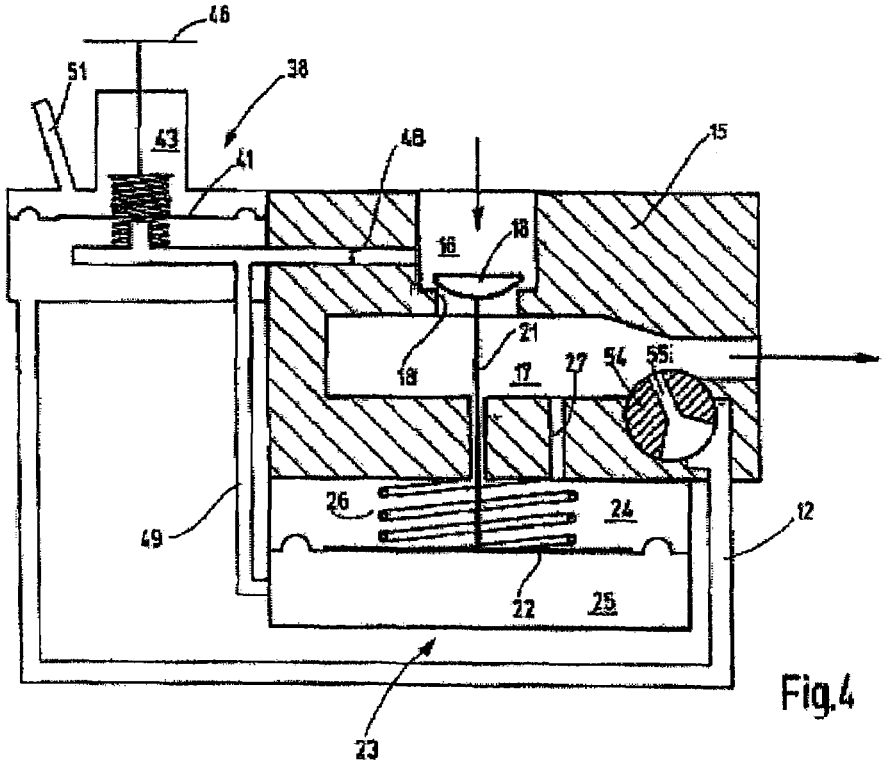
FIG. 4 shows another modified embodiment of a ratio controller in a schematic cross section.

The two embodiments just described start from fixed measurement sites 31, 32. However, it is possible to get by with only a single measurement site, if this is designed to be variable in location. This is shown in FIG. 4 with reference to an embodiment with a measurement site 55 provided at a rotary slide valve 54. The rotary slide valve 54 forms a narrow passage in the outflow chamber 17. Depending on the rotational position of the rotary slide valve 54, the measurement site 55 is at a narrow passage or (if rotated leftward in FIG. 4) at a wide location. The rotary slide valve 54 is connected to the pulse line 12. With rotation of the rotary slide valve 54, not only does the position of the measurement site 55 change with reference to the flow rate recorded, but so does its alignment relative to the flow direction. The magnitude of the tapped pressure and the effect of the gas velocity on it can therefore be regulated. As a result, the gas-air ratio can be regulated for a broad load range by means of the rotational position of rotary slide valve 54. Throttle valve block 33 can be dispensed with here. The pulse line is then connected directly to pilot valve 38. Otherwise, the function of the ratio controller 6 of this embodiment matches the function of the ratio controller described above.

Figure 6:
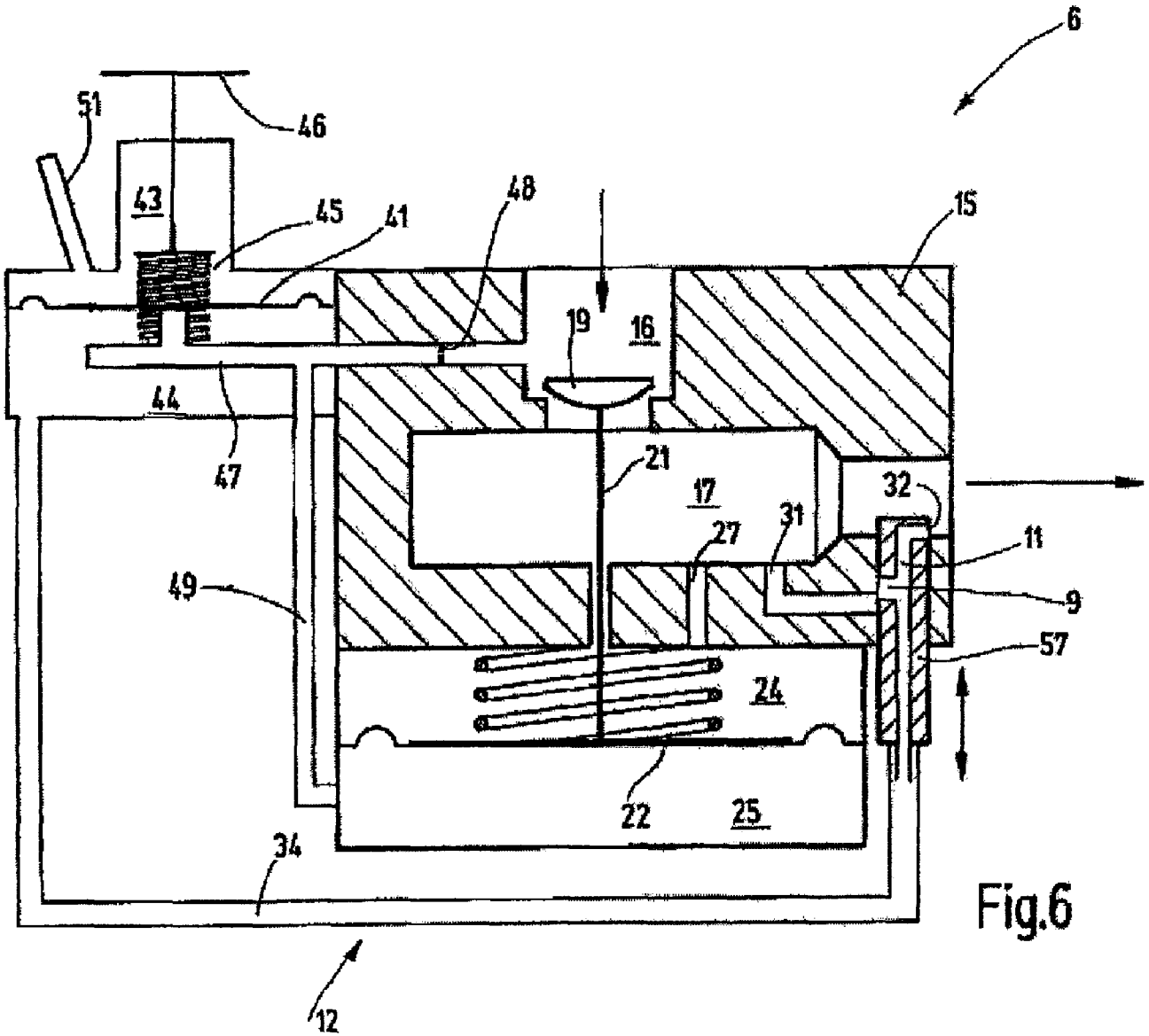
FIG. 6 shows another modified embodiment of a ratio controller in a schematic cross section.

Another modified embodiment of the ratio controller 6 is shown in FIG. 6. This is based largely on the embodiment according to FIG. 4, and the description uses the same reference numbers. However, instead of rotary slide valve 54 with only a single measurement site 55, a combined gate valve 57 is provided that has opening 32 at its front or, as shown, in its back. The gate valve can be made cylindrical or cuboid. Branch 11 is connected to opening 32, which is combined in the gate valve element with an additional branch 9. Branch 9 is connected to opening 31. The gate valve 57 can be pushed axially in order to more or less narrow the channel leading from the outflow chamber 17. The pressure value recorded at the opening 32 then changes accordingly. In addition, adjustment of the gate valve for throttling branch 9 can be used. However, it is preferable to make the cross section of the channels making up branch 9 large enough so that full passage through opening 31 into branch 9 and into pressure measurement line 34 is present in each useful position of gate valve 57.

Figure 7:
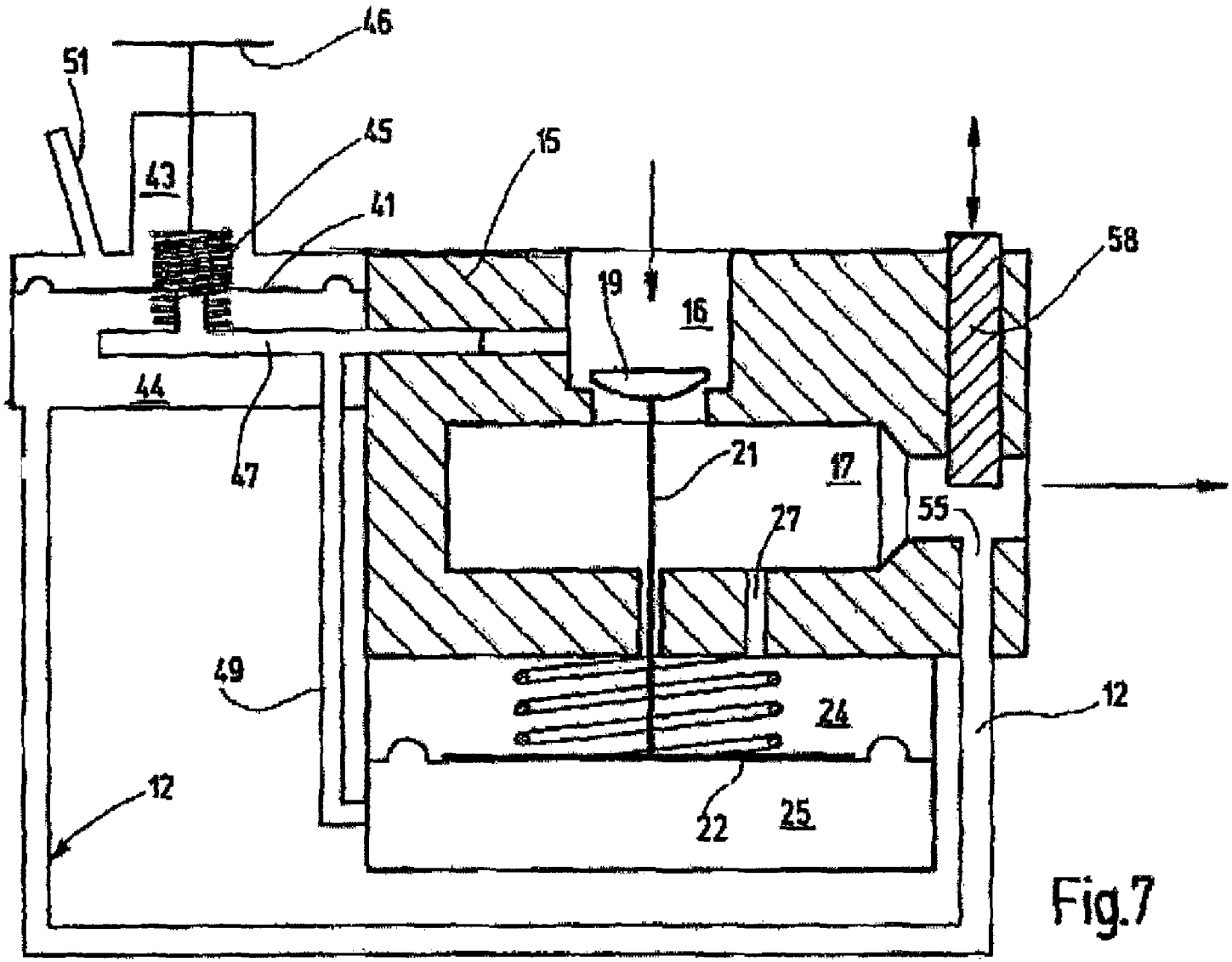
FIG. 7 shows a simplified embodiment of a ratio controller in a schematic cross section.

FIG. 7 shows another embodiment of the ratio controller 6, based on the embodiment according to FIG. 4. The same reference numbers apply to this description. However, instead of rotary slide valve 54, which is penetrated transversely by a measurement channel, a passive gate valve 58 is provided that is arranged opposite measurement site 55. Depending on the gate valve position, the free flow cross section prevailing in front of measurement site 55 is more or less narrowed. The gate valve can be a flat body valve or a round body valve. It can be provided with a threaded adjustment device or another means of adjustment. If it narrows the flow channel before the measurement site 55, a larger flow rate prevails here and a lower static gas pressure is tapped. If the flow cross section is widened, a comparatively higher gas pressure is tapped. This embodiment can also be used in an embodiment related to the ratio controller 6 according to FIG. 6, in which the line 12 is divided into two branches 9, 11, branch 9 leading to a measurement site 31, as shown according to FIG. 6, whereas branch 11 leads to measurement site 55. In this arrangement, a fuel gas/air ratio adjustment can also be effected by adjusting gate valve 58.

Figure 5:
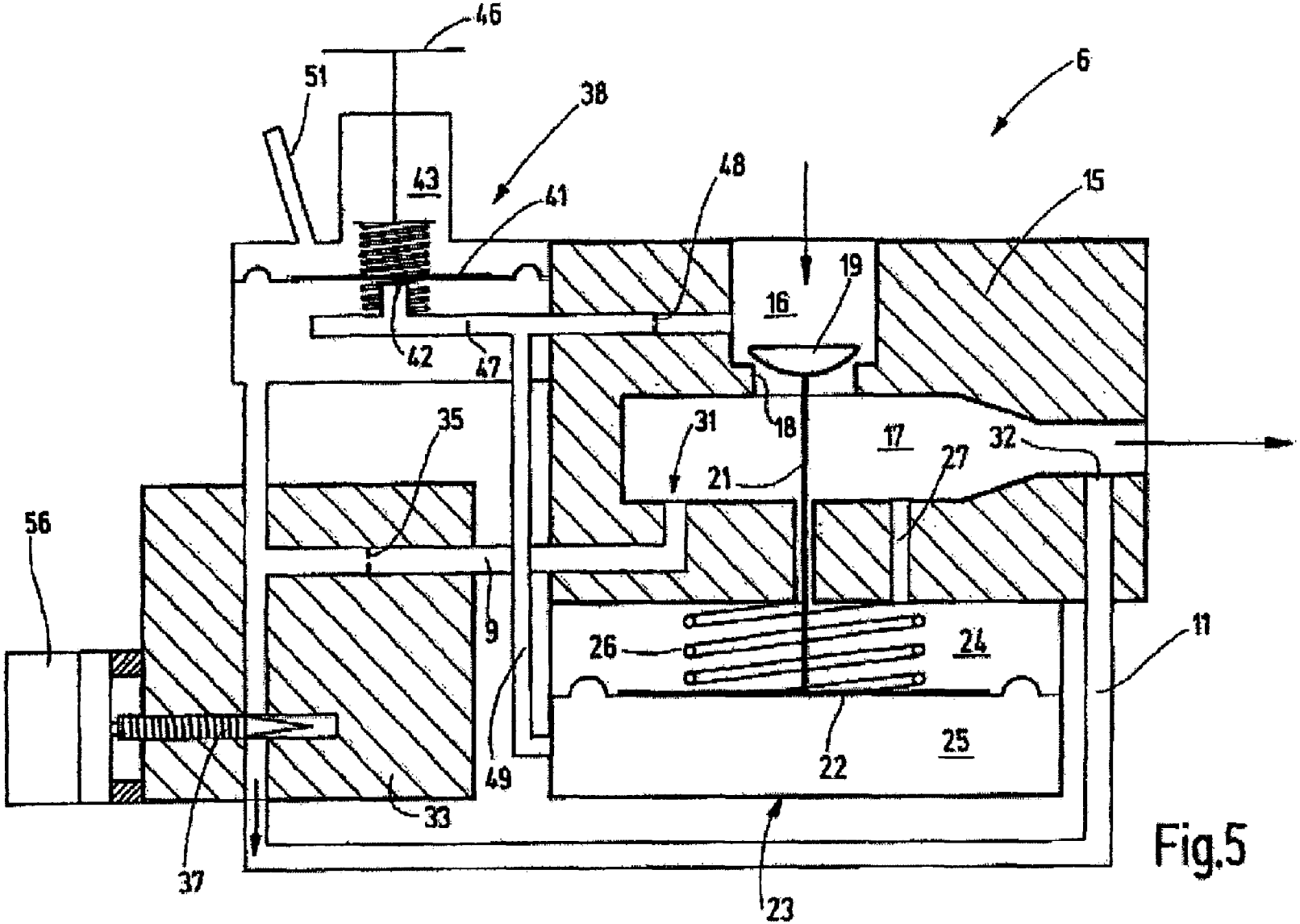
FIG. 5 shows a ratio controller with remote-controlled adjustment of the gas-air ratio in a schematic cross section.

All of the described ratio controllers 6 can be adjusted manually. It is also possible to adjust the mentioned ratio controller with a remote-controlled adjustment device, for example, a servomotor 56, with respect to gas flow and therefore gas-air ratio. FIG. 5 shows this based on the ratio controller according to FIG. 2. Appropriate servomotors can, however, also be mounted on the ratio adjustment devices of the other disclosed ratio controllers 6. The servomotor 56 can be connected to a control device that is not further shown in FIG. 1, and used to adjust the gas-air ratio. This can be connected, for example, to appropriate probes or sensors or input devices in order to produce an adjustment signal from the measured operating conditions or control commands.

To adjust a desired gas-air ratio on a burner over the widest possible load range without additional pressure tapping from the burner, a combustion chamber, or air lines, a ratio controller 6 is provided that permits an adjustment of the gas flow as a function of counterpressure. For adjustment, the ratio controller 6 has at least one position-variable measurement site 55, or at least two measurement sites 31, 32, that are connected via a valve block or throttle valve block 33, directly or indirectly via a pilot valve, to an actuating diaphragm 23. Depending on whether the control pressure is picked up more from one or the other measurement site, the gas flow and therefore the gas-air ratio can be made smaller or larger.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A ratio controller for fuel gas metering of a gas burner comprising:

a housing, in which at least one valve seat and at least one valve closure element adjustably associated with the valve seat are arranged, which divides the interior of a valve housing into an inflow chamber and an outflow chamber, an actuating diaphragm, to which the valve closure element is connected, in order to adjust the valve closure element according to a pressure difference, and a pulse channel to influence the actuating diaphragm, in which pressure tapping is effected via the pulse channel:

at an adjustable measurement site, simultaneously at at least two different measurement sites of the outflow chamber or of a connected gas line with different flow conditions, or a combination thereof.

2. The ratio controller according to claim 1, wherein an adjustment device for adjusting the position of the pressure tap is arranged on the ratio controller.

3. The ratio controller according to claim 2, wherein the different positions of the adjustment device differ by a different flow direction at the pressure tap.

4. The ratio controller according to claim 2, wherein the different positions of the adjustment device differ by the different flow cross sections at the pressure tap.

5. The ratio controller according to claim 1, wherein the pulse channel is connected to a pilot control valve.

6. The ratio controller according to claim 1, wherein branches belong to the pulse channel and lead from different measurement sites of the outflow chamber or gas line to a pneumatic ratio adjustment valve that is connected to a pilot control valve.

7. The ratio controller according to claim 6, wherein an adjustable throttle valve is arranged in at least one of the branches.

8. The ratio controller according to claim 6, wherein a three/two distribution valve is arranged between branches.

9. The ratio controller according to claim 7, wherein the throttle valve is continuously adjustable.

10. The ratio controller according to claim 8, wherein the three/two distribution valve is continuously adjustable.

11. The ratio controller according to claim 9, wherein the throttle valve is adjustable by a servodrive under the control of a control device.

12. The ratio controller according to claim 1, wherein the pilot valve has a control diaphragm, acted upon on one side by the pressure of the pulse line, which controls a pressure channel that leads from the inflow chamber to the diaphragm valve.

13. The ratio controller according to claim 12, wherein the other side of the control diaphragm is acted upon by the ambient air pressure.

14. The ratio controller according to claim 12, wherein the other side of the control diaphragm is acted upon by the pressure prevailing in front of a gas/air mixture formation device.

15. The ratio controller according to claim 1, wherein a connection channel is provided between the outflow chamber and the actuating diaphragm.

16. The ratio controller according to claim 10, wherein the three/two distribution valve is adjustable by a servodrive under the control of a control device.

17. A ratio controller for fuel gas metering of a gas burner comprising:

a housing having at least one valve seat and at least one valve closure element adjustably associated with the valve seat arranged so that the interior of a valve housing is divided into an inflow chamber and an outflow chamber, an actuating diaphragm connected to the valve closure element to adjust the valve closure element according to a pressure difference, and a pulse channel to influence the actuating diaphragm, in which pressure tapping is effected by the pulse channel:

at an adjustable measurement site, simultaneously at at least two different measurement sites of the outflow chamber or of a connected gas line with different flow conditions, or a combination thereof.

18. The ratio controller according to claim 17, wherein an adjustment device for adjusting the position of the pressure tap is arranged on the ratio controller.

19. The ratio controller according to claim 18, wherein the different positions of the adjustment device differ by a different flow direction at the pressure tap.

20. The ratio controller according to claim 18, wherein the different positions of the adjustment device differ by the different flow cross sections at the pressure tap.

21. The ratio controller according to claim 17, wherein the pulse channel is connected to a pilot control valve.

22. The ratio controller according to claim 17 wherein branches belong to the pulse channel and lead from different measurement sites of the outflow chamber or gas line to a pneumatic ratio adjustment valve that is connected to a pilot control valve.

23. The ratio controller according to claim 22, wherein an adjustable throttle valve is arranged in at least one of the branches.

24. The ratio controller according to claim 22, wherein a three/two distribution valve is arranged between branches.

25. The ratio controller according to claim 23, wherein the throttle valve is continuously adjustable.

26. The ratio controller according to claim 24, wherein the three/two distribution valve is continuously adjustable.

27. The ratio controller according to claim 25, wherein the throttle valve is adjustable by a servodrive under the control of a control device.

28. The ratio controller according to claim 17, wherein the pilot valve has a control diaphragm, acted upon on one side by the pressure of the pulse line, which controls a pressure channel that leads from the inflow chamber to the diaphragm valve.

29. The ratio controller according to claim 28, wherein the other side of the control diaphragm is acted upon by the ambient air pressure.

30. The ratio controller according to claim 28, wherein the other side of the control diaphragm is acted upon by the pressure prevailing in front of a gas/air mixture formation device.

31. The ratio controller according to claim 17, wherein a connection channel is provided between the outflow chamber and the actuating diaphragm.

32. The ratio controller according to claim 26, wherein the three/two distribution valve is adjustable by a servodrive under the control of a control device.

* * * * *